US012722050B2

(12) United States Patent
Nakamura

(10) Patent No.: US 12,722,050 B2
(45) Date of Patent: Sep. 1, 2026

(54) GOLF CLUB HEAD

(71) Applicant: SUMITOMO RUBBER INDUSTRIES, LTD., Kobe (JP)

(72) Inventor: Takashi Nakamura, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 300 days.

(21) Appl. No.: 18/527,032

(22) Filed: Dec. 1, 2023

(65) Prior Publication Data

US 2024/0181305 A1 Jun. 6, 2024

(30) Foreign Application Priority Data

Dec. 6, 2022 (JP) ..... 2022-194666

(51) Int. Cl.
*A63B 53/04* (2015.01)

(52) U.S. Cl.
CPC ..... *A63B 53/0458* (2020.08); *A63B 53/0408* (2020.08)

(58) Field of Classification Search
CPC ..... A63B 53/0458; A63B 53/0462; A63B 53/0466
See application file for complete search history.

(56) References Cited

U.S. PATENT DOCUMENTS 6,904,663 B2 * 6/2005 Willett ..... A63B 53/0466 29/557
8,353,786 B2 * 1/2013 Beach ..... A63B 60/02 473/345
2004/0099538 A1 * 5/2004 Chao ..... B23H 9/00 205/705

FOREIGN PATENT DOCUMENTS

CN 201862222 U 6/2011
JP 2003-135630 A 5/2003
JP 2013-66535 A 4/2013

* cited by examiner

*Primary Examiner* — Raeann Gorden
(74) *Attorney, Agent, or Firm* — Birch, Stewart, Kolasch & Birch, LLP

(57) ABSTRACT

A face portion of a head includes a striking face constituting an outer surface of the face portion, a face inner surface constituting an inner surface of the face portion, and a face thickness. The striking face includes a face center. The face portion includes: a face central thin-wall section including the face center; a toe thick-wall section thicker than the face central thin-wall section, positioned spaced 8 mm or more apart from the face center toward a toe side, and extending in an up-down direction; and a heel thick-wall section thicker than the face central thin-wall section, positioned spaced 8 mm or more apart from the face center toward a heel side, and extending in the up-down direction. The toe thick-wall section and the heel thick-wall section extend to a position that does not reach an outer edge of the face portion.

19 Claims, 13 Drawing Sheets

Cross section taken along line E1

GOLF CLUB HEAD

CROSS REFERENCE TO RELATED APPLICATION

The present application claims priority to Japanese Patent Application No. 2022-194666 filed on Dec. 6, 2022. The entire contents of this Japanese Patent Application are hereby incorporated by reference.

BACKGROUND

Technical Field

The present disclosure relates to golf club heads.

Description of the Related Art

There has been demand for a head having a high rebound performance. Thinning a face portion for enhancing rebound performance, however, reduces durability. JP2003-135630A discloses a wood type golf club head that can improve rebound performance while not impairing durability, which includes a center thick-wall portion and a peripheral thin-wall portion that surrounds the center thick-wall portion.

SUMMARY

There has been demand for a head having a still higher rebound performance and excellent durability. One of the objects of the present disclosure is to provide a golf club head that has a high rebound performance and excellent durability.

In one aspect, a golf club head includes a face portion, a crown portion, a sole portion, and a hosel portion. The face portion includes a striking face that constitutes an outer surface of the face portion, a face inner surface that constitutes an inner surface of the face portion, and a face thickness that is defined as a distance between the striking face and the face inner surface. The striking face includes a face center. The face portion includes: as a distribution of the face thickness, a face central thin-wall section that includes the face center; a toe thick-wall section that is thicker than the face central thin-wall section, that is positioned spaced 8 mm or more apart from the face center toward a toe side, and that extends in an up-down direction; and a heel thick-wall section that is thicker than the face central thin-wall section, that is positioned spaced 8 mm or more apart from the face center toward a heel side, and that extends in the up-down direction. The toe thick-wall section extends to a position that does not reach an outer edge of the face portion. The heel thick-wall section extends to a position that does not reach the outer edge of the face portion.

BRIEF DESCRIPTION OF THE DRAWINGS

FIG. 11 shows sections/parts of a face portion with different hatchings;

DESCRIPTION OF THE PREFERRED EMBODIMENTS

Hereinafter, the present disclosure will be described in detail based on preferred embodiments with appropriate references to the accompanying drawings.

In the present disclosure, a reference state, a reference perpendicular plane, a toe-heel direction, a face-back direction, an up-down direction, a face center, a vertical cross section, a horizontal cross section, and a face front view are defined as follows.

Figure 13:
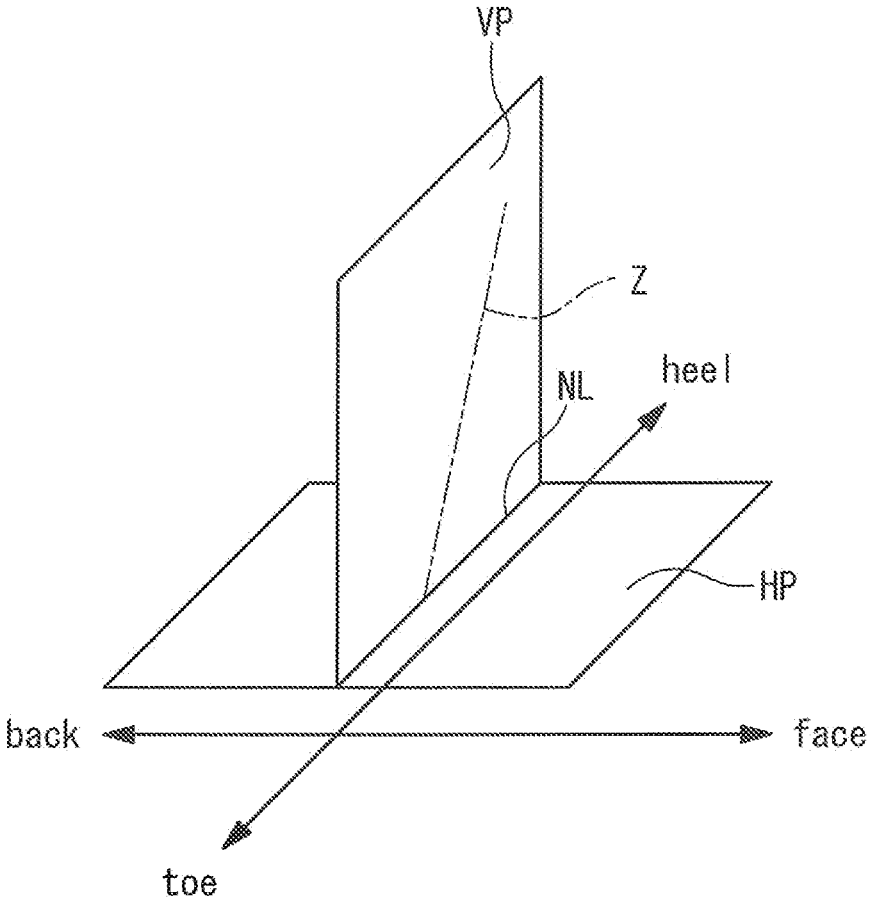
FIG. 13 is a conceptual diagram for illustrating a reference state.

The reference state is a state where a head is placed at a predetermined lie angle on a ground plane HP. As shown in FIG. 13, in the reference state, a shaft axis line Z lies on (is contained in) a plane VP that is perpendicular to the ground plane HP. The shaft axis line Z is the center line of a shaft. The shaft axis line Z normally coincides with the center line of a hosel hole. The plane VP is referred to as the reference perpendicular plane. The predetermined lie angle is shown in a product catalog, for example.

There has been known a club in which its loft angle, lie angle and face angle can be adjusted by, for example, changing a rotational position of a sleeve provided at a tip portion of a shaft. In such a club, the sleeve can be detachably fixed to the head with a fixing means such as a screw. For this reason, in this club, the shaft is attachable to/detachable from the head. In a club having such an attachable/detachable mechanism, all adjustable items are set to be neutral when the club is in the reference state. The term "neutral" means the center of the range of adjustment. The club of the present disclosure may include such an attachable/detachable mechanism.

In the reference state, a face angle is 0°. That is, in a planar view of a head as viewed from above, a line normal to its striking face at the face center is set to be perpendicular to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 13). A toe side in the toe-heel direction is also simply referred to as "toe side". A heel side in the toe-heel direction is also simply referred to as "heel side".

In the present disclosure, the face-back direction is a direction that is perpendicular to the toe-heel direction and is parallel to the ground plane HP. A face side in the face-back direction is also simply referred to as "face side". A back side in the face-back direction is also simply referred to as "back side".

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

In the present disclosure, the vertical cross section is defined as each of cross sections taken along respective planes perpendicular to the toe-heel direction. In the present disclosure, the horizontal cross section is defined as each of cross sections taken along respective planes perpendicular to the up-down direction. In other words, the horizontal cross section in the present disclosure means each of cross sections taken along respective planes parallel to the ground plane HP.

In the present disclosure, the face front view means an orthogonal projection of a head obtained by projecting the head in a projecting direction that is a direction of a line normal to the striking face at the face center Fc. Unless otherwise described, shapes, areas, dimensions and the like of respective sections/parts of a face portion are determined in the face front view. The face front view is also simply referred to as a front view in the present disclosure.

Figure 1:
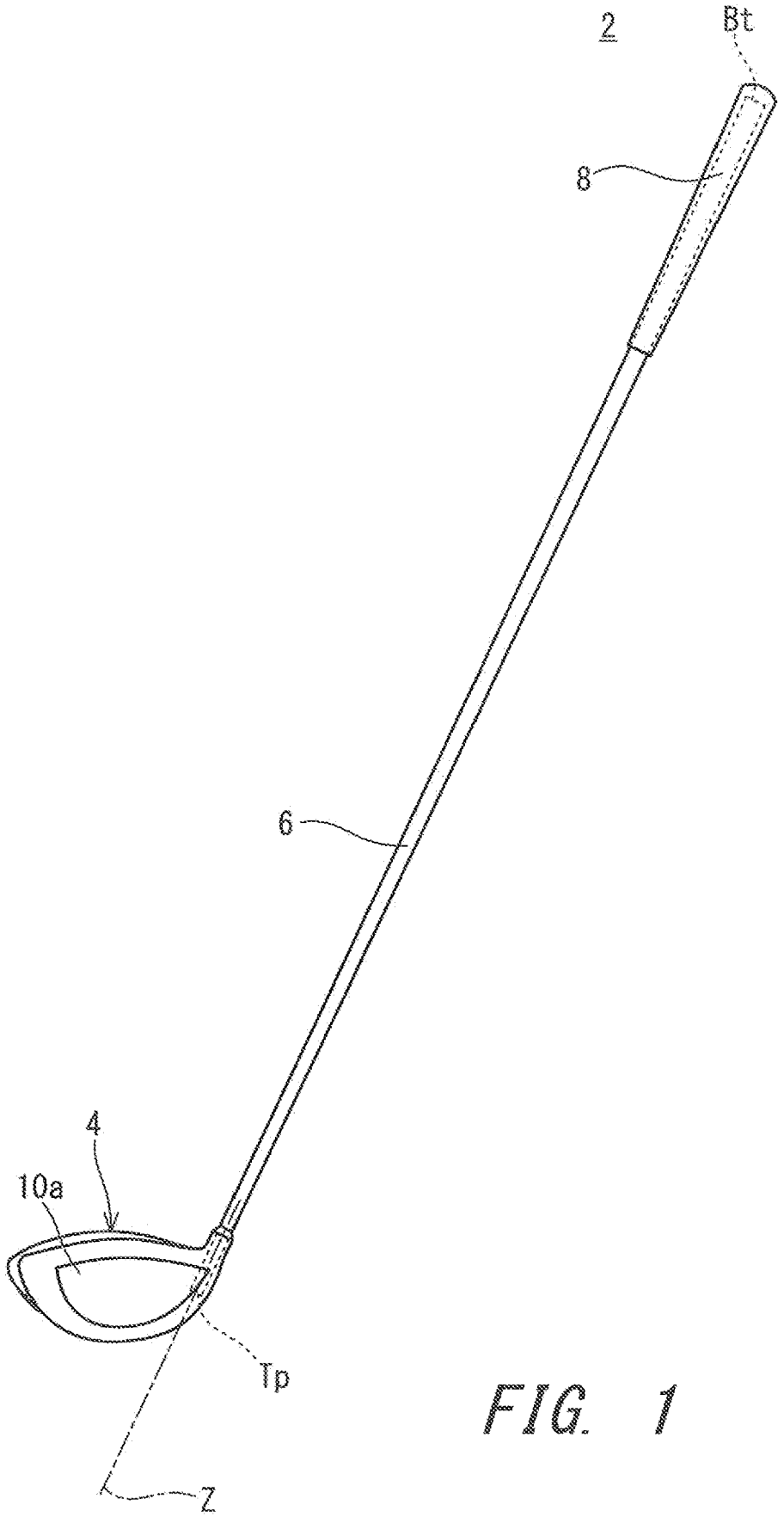
FIG. 1 shows a golf club that includes a golf club head according to a first embodiment.
Figure 2A:
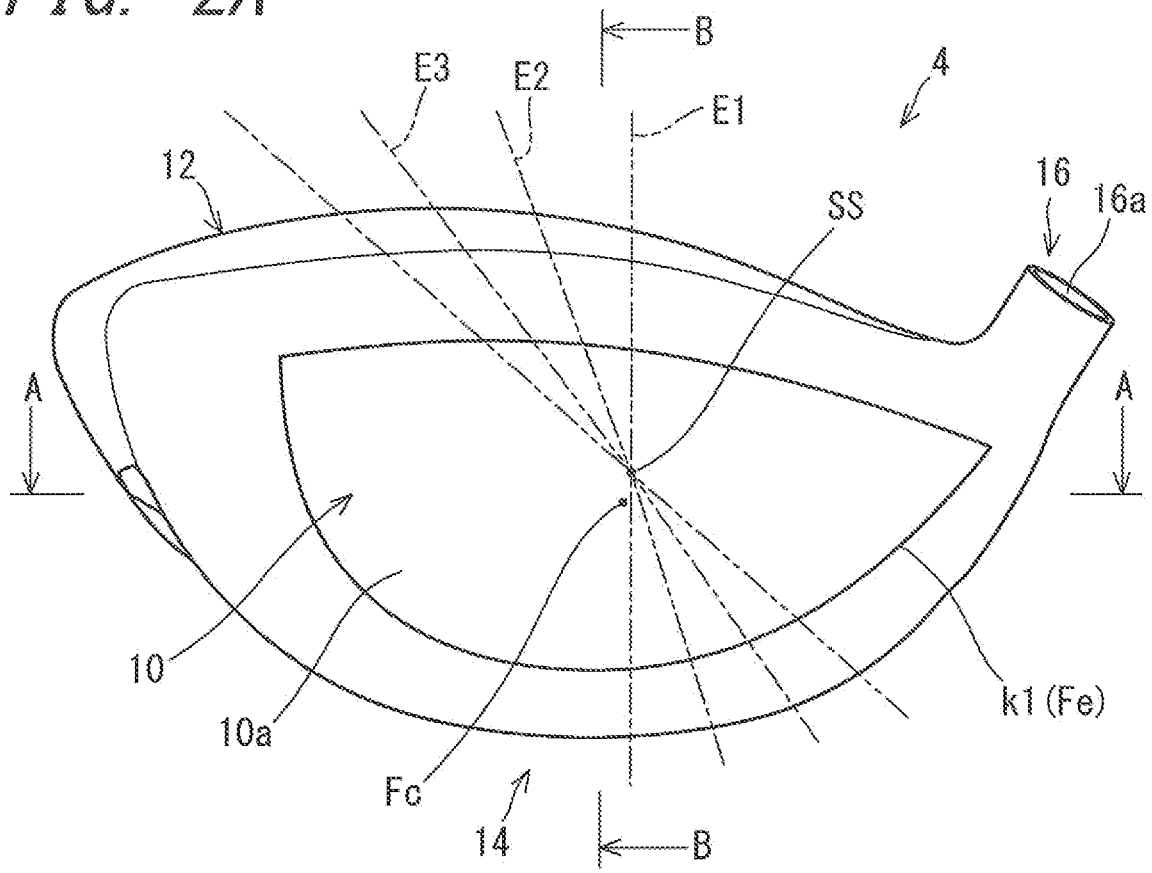
FIG. 2A is a front view of the head of the first embodiment as viewed from a face side.
Figure 2B:
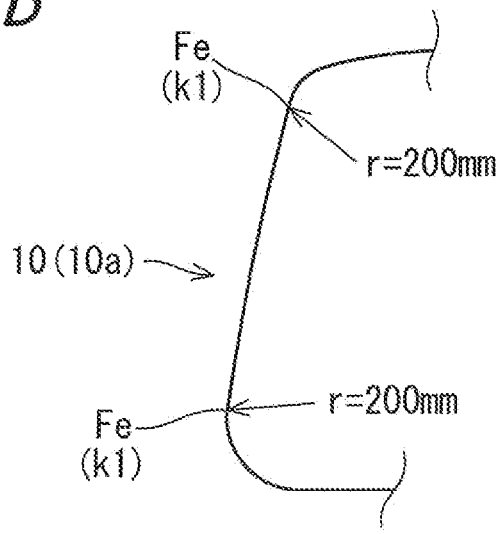
FIG. 2B shows a cross-section taken along line E1 in FIG. 2A, FIG. 2B showing only a cross-sectional contour line of the head outer surface.
Figure 3:
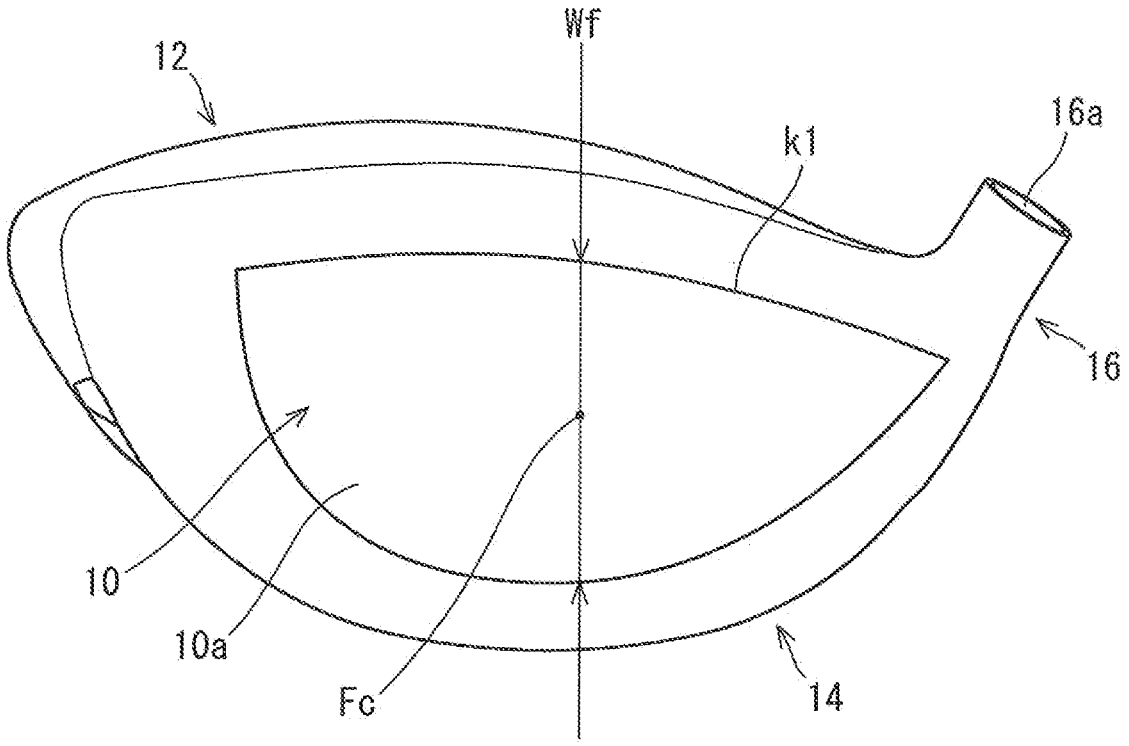
FIG. 3 is the same front view as FIG. 2A.
Figure 4:
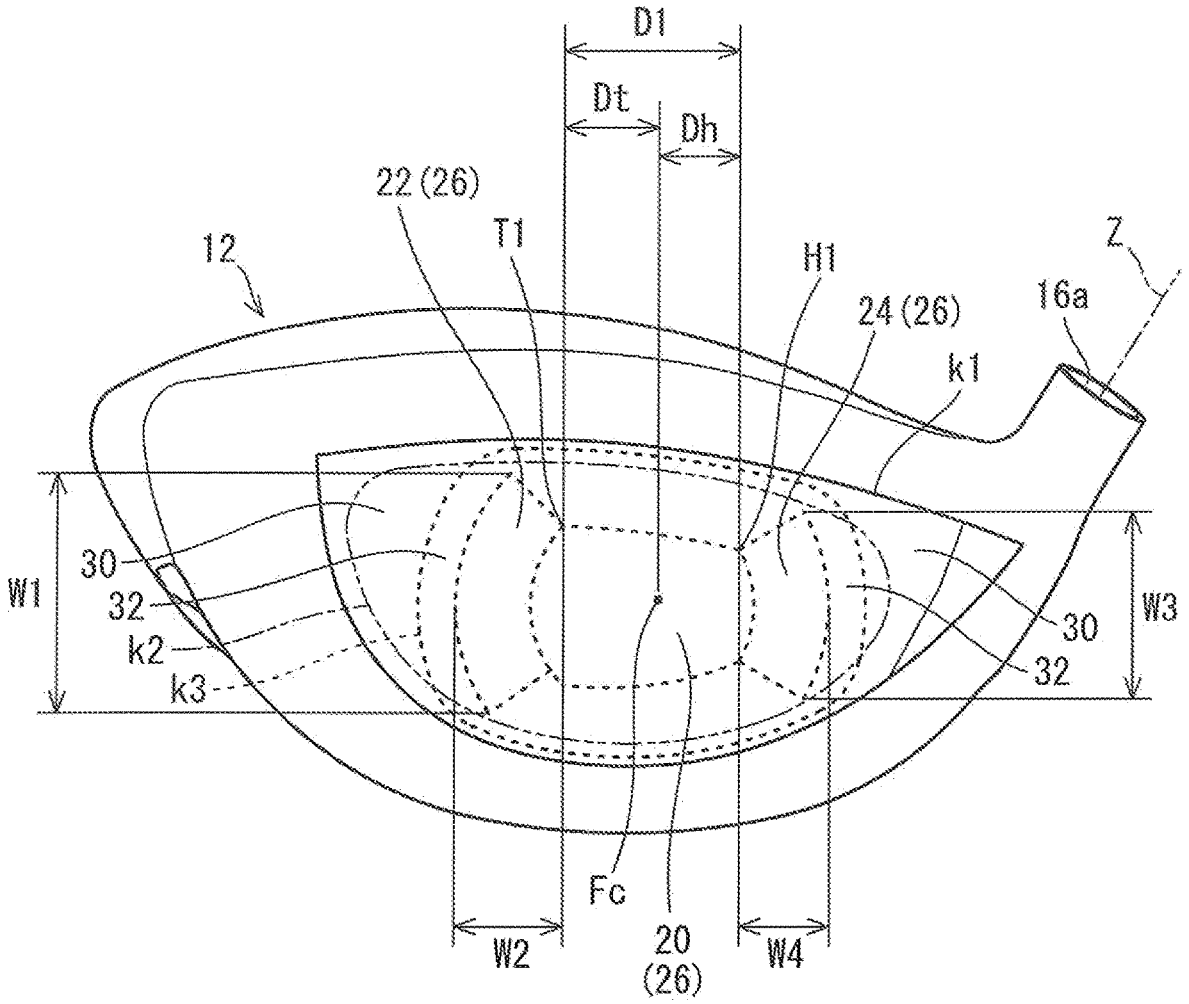
FIG. 4 is the same front view as FIG. 2A, FIG. 4 showing contour lines of sections/parts of a face portion with dashed lines.

FIG. 1 is an overall view of a golf club 2 that includes a head 4 according to a first embodiment of the present disclosure. FIG. 2A is a front view of the head 4, and FIG. 2B is a cross-sectional view taken along line E1 in FIG. 2A. FIG. 3 and FIG. 4 are the same front views as FIG. 2A, and are the above-described face front views. FIG. 4 shows contour lines of sections/parts of a face portion 10 with dashed lines. FIG. 4 also shows a boundary k2 between a body member 4*a* and a face member 4*b* with a dot-dot-dash line.

As shown in FIG. 1, the golf club 2 includes the golf club head 4, a shaft 6, and a grip 8. The shaft 6 has a tip end Tp and a butt end Bt. The head 4 is attached to a tip end portion of the shaft 6. The grip 8 is attached to a butt end portion of the shaft 6.

The golf club 2 is a driver (No. 1 wood). The head 4 is a head used for drivers. Typically, the club as a driver has a length of greater than or equal to 43 inches and less than or equal to 48 inches. Preferably, the golf club 2 is a wood-type golf club or a hybrid-type golf club.

The shaft 6 is in a tubular form. The shaft 6 is hollow. The material of the shaft 6 is a carbon fiber reinforced resin. From the viewpoint of weight reduction, a carbon fiber reinforced resin is preferable as a material for the shaft 6. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. The term "UD" stands for unidirectional. A prepreg other than the UD prepreg may be used. For example, fibers contained in the prepreg sheet may be woven. The shaft 6 may include a metal wire. The material of the shaft 6 is not limited, and may be a metal, for example.

The grip 8 is a part that a golfer grips during a swing. Examples of the material of the grip 8 include rubber compositions and resin compositions. The rubber composition for the grip 8 may contain air bubbles.

The head 4 is hollow. In the present embodiment, the head 4 is a wood type head. The head 4 may be a hybrid type head. The head 4 may be an iron type head. The head 4 may be a putter type head. The head 4 is preferably a wood type head or a hybrid type head, and more preferably a wood type head. Examples of a preferable material for the head 4 include metals and fiber reinforced plastics. Examples of the metals include titanium alloys, pure titanium, stainless steel, maraging steel, and soft iron. Examples of the fiber reinforced plastics include carbon fiber reinforced plastics. The head 4 may be a composite head including a portion made of a metal and a portion made of a fiber reinforced plastic.

The head 4 includes a face portion 10, a crown portion 12, a sole portion 14, and a hosel portion 16. The face portion 10 includes a striking face 10*a*. The striking face 10*a* constitutes the outer surface of the face portion 10. The striking face 10*a* is also simply referred to as a face or a face surface. The striking face 10*a* includes a face center Fc as defined above. The hosel portion 16 has a shaft hole 16*a*.

A double-pointed arrow Wf in FIG. 3 shows a width of the striking face 10*a* (face portion 10) in the up-down direction (hereinafter also referred to as an up-down directional width Wf). The up-down directional width Wf is measured at the position of the face center Fc.

An outer edge k1 of the striking face 10*a* can be defined as follows. As shown in FIG. 2A and FIG. 2B, there are cross sections each of which contains a straight line that connects a center of gravity of the head 4 and a sweet spot SS, for example, cross sections E1, E2, and E3 in FIG. 2A. In each of the cross sections, when a curvature radius r of the cross-sectional contour line of the head outer surface is sequentially observed from the sweet spot SS toward the outside of the striking face 10*a*, a point at which the curvature radius r becomes 200 mm for the first time is defined as a position Fe. A set of the positions Fe can be the outer edge k1 of the striking face 10*a*. Note that the sweet spot SS means a foot of a perpendicular drawn from the center of gravity of the head 4 to the striking face 10*a*.

From the viewpoint of members constituting the head 4, the head 4 includes the body member 4*a* and the face member 4*b*. FIG. 4 shows the boundary k2 between the body member 4*a* and the face member 4*b* with a dot-dot-dash line. The boundary k2 is a contour line of the face member 4*b*. The body member 4*a* and the face member 4*b* are welded to each other. The face member 4*b* constitutes a part (center part) of the striking face 10*a*. The entirety of the outer surface of the face member 4*b* is the striking face 10*a*. The body member 4*a* is a plate member (see FIG. 7 and FIG. 8 described below). Note that a weld bead can cause a localized increase of a face thickness t at the boundary k2. Such a weld bead is not shown in FIG. 7 or FIG. 8 explained below.

The face portion 10 has a distribution of face thickness. The face portion 10 includes a face central thin-wall section 20, a toe thick-wall section 22, and a heel thick-wall section 24. The term "thickness" in the present disclosure means face thickness.

The face central thin-wall section 20 includes the face center Fc. The face central thin-wall section 20 includes the sweet spot SS. The face central thin-wall section 20 is thinner than the toe thick-wall section 22. The face central thin-wall section 20 is thinner than the heel thick-wall section 24.

The entirety of the face central thin-wall section 20 is positioned in the face portion 10. The entirety of the face central thin-wall section is positioned inside the outer edge k1 of the face portion 10. The face central thin-wall section does not reach the outer edge k1 of the face portion 10.

The toe thick-wall section 22 is thicker than the face central thin-wall section 20. The toe thick-wall section 22 is located spaced 8 mm or more apart from the face center Fc toward the toe side. This "8 mm" is measured in the toe-heel direction. The toe thick-wall section 22 has a point Ti that is located at a heel-most position in the toe thick-wall section 22. A double-pointed arrow Dt in FIG. 4 shows a distance between the point Ti and the face center Fc in the toe-heel direction. The distance Dt is greater than or equal to 8 mm.

The toe thick-wall section 22 extends in the up-down direction. That is, the toe thick-wall section 22 has a length W1 in the up-down direction (hereinafter also referred to as up-down directional length W1). The toe thick-wall section 22 also has a length W2 in the toe-heel direction (hereinafter also referred to as toe-heel directional length W2). The length W1 is longer than the length W2. Alternatively, the length W1 may be shorter than the length W2. The length W1 may be equal to the length W2.

The entirety of the toe thick-wall section 22 is positioned in the face portion 10. The entirety of the toe thick-wall section 22 is positioned inside the outer edge k1 of the face portion 10. The entirety of the toe thick-wall section 22 is positioned on the toe side with respect to the face center Fc. The toe thick-wall section 22 includes a part that is located on the upper side with respect to the face center Fc. The toe thick-wall section 22 includes a part that is located on the lower side with respect to the face center Fc. The toe thick-wall section 22 does not reach the outer edge k1 of the face portion 10.

The heel thick-wall section 24 is thicker than the face central thin-wall section 20. The heel thick-wall section 24 is located spaced 8 mm or more apart from the face center Fc toward the heel side. This "8 mm" is measured in the toe-heel direction. The heel thick-wall section 24 has a point Hi that is located at a toe-most position in the heel thick-wall section 24. A double-pointed arrow Dh in FIG. 4 shows a distance between the point Hi and the face center Fc in the toe-heel direction. The distance Dh is greater than or equal to 8 mm. In the present embodiment, the distance Dt is greater than the distance Dh.

The heel thick-wall section 24 extends in the up-down direction. That is, the heel thick-wall section 24 has a length W3 in the up-down direction (hereinafter also referred to as up-down directional length W3). The heel thick-wall section 24 also has a length W4 in the toe-heel direction (hereinafter also referred to as toe-heel directional length W4). The length W3 is longer than the length W4. Alternatively, the length W3 may be shorter than the length W4. The length W3 may be equal to the length W4.

The entirety of the heel thick-wall section 24 is positioned in the face portion 10. The entirety of the heel thick-wall section 24 is positioned inside the outer edge k1 of the face portion 10. The entirety of the heel thick-wall section 24 is positioned on the heel side with respect to the face center Fc. The heel thick-wall section 24 has a part that is located on the upper side with respect to the face center Fc. The heel thick-wall section 24 has a part that is located on the lower side with respect to the face center Fc. The heel thick-wall section 24 does not reach the outer edge k1 of the face portion 10.

The face central thin-wall section 20 may have a constant thickness, or may have a varying thickness. The toe thick-wall section 22 may have a constant thickness, or may have a varying thickness. The heel thick-wall section 24 may have a constant thickness, or may have a varying thickness. When the thickness of the face central thin-wall section and/or the thickness of the toe thick-wall section 22 varies, the maximum value of the thickness of the face central thin-wall section 20 can be smaller than the minimum value of the thickness of the toe thick-wall section 22. When the thickness of the face central thin-wall section and/or the thickness of the heel thick-wall section 24 varies, the maximum value of the thickness of the face central thin-wall section 20 can be smaller than the minimum value of the thickness of the heel thick-wall section 24. In the present embodiment, the face central thin-wall section 20 has a constant thickness. Note that as to the term "constant thickness" in the present disclosure, variation ranging from minus 0.05 mm to plus 0.05 mm can be considered as a permitted tolerance.

The thickness of the face central thin-wall section 20 can be considered as an average value. As described below, the face central thin-wall section 20 has an area S1. When the volume of the face central thin-wall section 20 is denoted by M1, the average value of the thickness is M1/S1. Similarly, the thickness of the toe thick-wall section 22 and the thickness of the heel thick-wall section 24 can also be considered as average values.

The toe thick-wall section 22 adjoins the face central thin-wall section 20. The toe thick-wall section 22 is contiguous with the toe side of the face central thin-wall section 20. Alternatively, the toe thick-wall section 22 may be located apart from the face central thin-wall section 20.

The heel thick-wall section 24 adjoins the face central thin-wall section 20. The heel thick-wall section 24 is contiguous with the heel side of the face central thin-wall section 20. Alternatively, the heel thick-wall section 24 may be located apart from the face central thin-wall section 20.

The face central thin-wall section 20, the toe thick-wall section 22 and the heel thick-wall section 24 constitute a face main part 26. The face main part 26 is a combination of the face central thin-wall section 20, the toe thick-wall section 22, and the heel thick-wall section 24.

Figure 5:
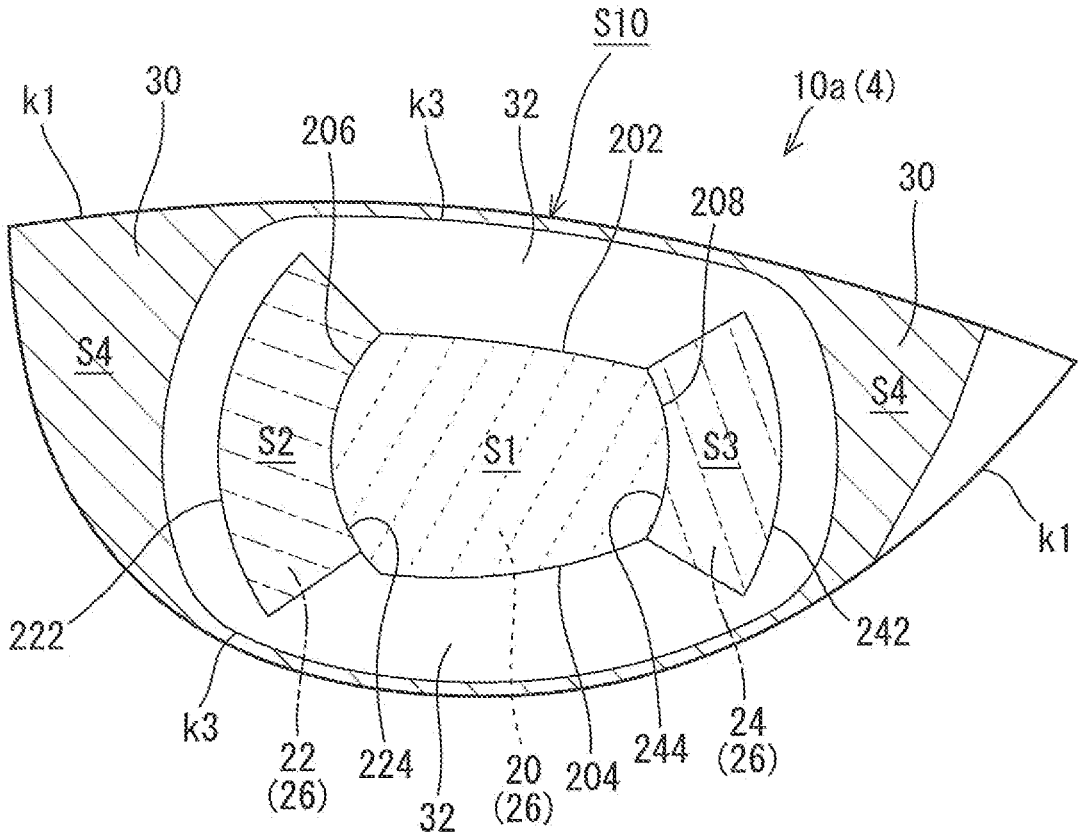
FIG. 5 shows an enlarged view of a striking face shown in FIG. 4, FIG. 5 showing the contour lines with solid lines instead of dashed lines in FIG. 4 and showing the sections/parts with different hatchings.

FIG. 5 is an enlarged view of the face portion in FIG. 4. The dashed lines in FIG. 4 are replaced with solid lines in FIG. 5. The boundary k2 is omitted in FIG. 5.

For the sake of easy understanding, FIG. 5 uses different hatchings for distinguishing the sections (parts). The face central thin-wall section 20 is shown with a dashed-line hatching, the toe thick-wall section 22 is shown with a dot-dash line hatching, and the heel thick-wall section 24 is shown with a dot-dot-dash line hatching.

The face portion 10 includes a peripheral part 30. FIG. 5 shows the peripheral part 30 with a solid-line hatching. The peripheral part 30 is positioned on the outer side of the face main part 26. The peripheral part 30 is formed around the face main part 26. The peripheral part 30 surrounds the entire periphery of the face main part 26. The outer contour line of the peripheral part 30 coincides with the outer edge k1, excluding a part of the outer contour line. The peripheral part 30 is thinner than the face central thin-wall section 20. The peripheral part 30 is thinner than the toe thick-wall section 22. The peripheral part 30 is thinner than the heel thick-wall section 24. The peripheral part 30 is thinner than the face main part 26. The peripheral part 30 is present between the face main part 26 and the outer edge k1 so as to surround the entire periphery (360°) of the face main part 26.

The face portion 10 includes a transition part 32. FIG. 5 shows the transition part 32 with no hatching. The transition part 32 is positioned between the face main part 26 and the peripheral part 30. The transition part 32 is positioned on the outer side of the face main part 26. The transition part 32 is formed around the face main part 26. The transition part 32 surrounds the entire periphery of the face main part 26. The transition part 32 adjoins the face main part 26. The transition part 32 adjoins the peripheral part 30. The transition part 32 has a thickness ranging from the thickness of the face main part 26 to the thickness of the peripheral part 30. The transition part 32 connects the face main part 26 and the peripheral part 30 with no step.

The face central thin-wall section 20 includes an upper contour line 202, a lower contour line 204, a toe-side contour line 206, and a heel-side contour line 208. The toe-side contour line 206 extends curvedly so as to protrude toward the toe side. The heel-side contour line 208 extends curvedly so as to protrude toward the heel side.

The toe thick-wall section 22 includes a face-peripheral contour line 222 that is a contour line on a side closer to the periphery of the face portion 10 and a face-central contour line 224 that is a contour line on a side closer to the central part of the face portion 10. The face-central contour line 224 coincides with the contour line 206 of the face central thin-wall section 20. The face-central contour line 224 extends curvedly so as to protrude toward the toe side. The face-peripheral contour line 222 extends curvedly so as to protrude toward the toe side.

The heel thick-wall section 24 includes a face-peripheral contour line 242 that is a contour line on a side closer to the periphery of the face portion 10 and a face-central contour line 244 that is a contour line on a side closer to the central part of the face portion 10. The face-central contour line 244 coincides with the contour line 208 of the face central thin-wall section 20. The face-central contour line 244 extends curvedly so as to protrude toward the heel side. The face-peripheral contour line 242 extends curvedly so as to protrude toward the heel side.

The transition part 32 includes an outer peripheral contour line k3. The outer peripheral contour line k3 surrounds the entirety of the face main part 26. The entirety of the outer peripheral contour line k3 is positioned inside the outer edge k1 of the face portion 10.

Figure 6:
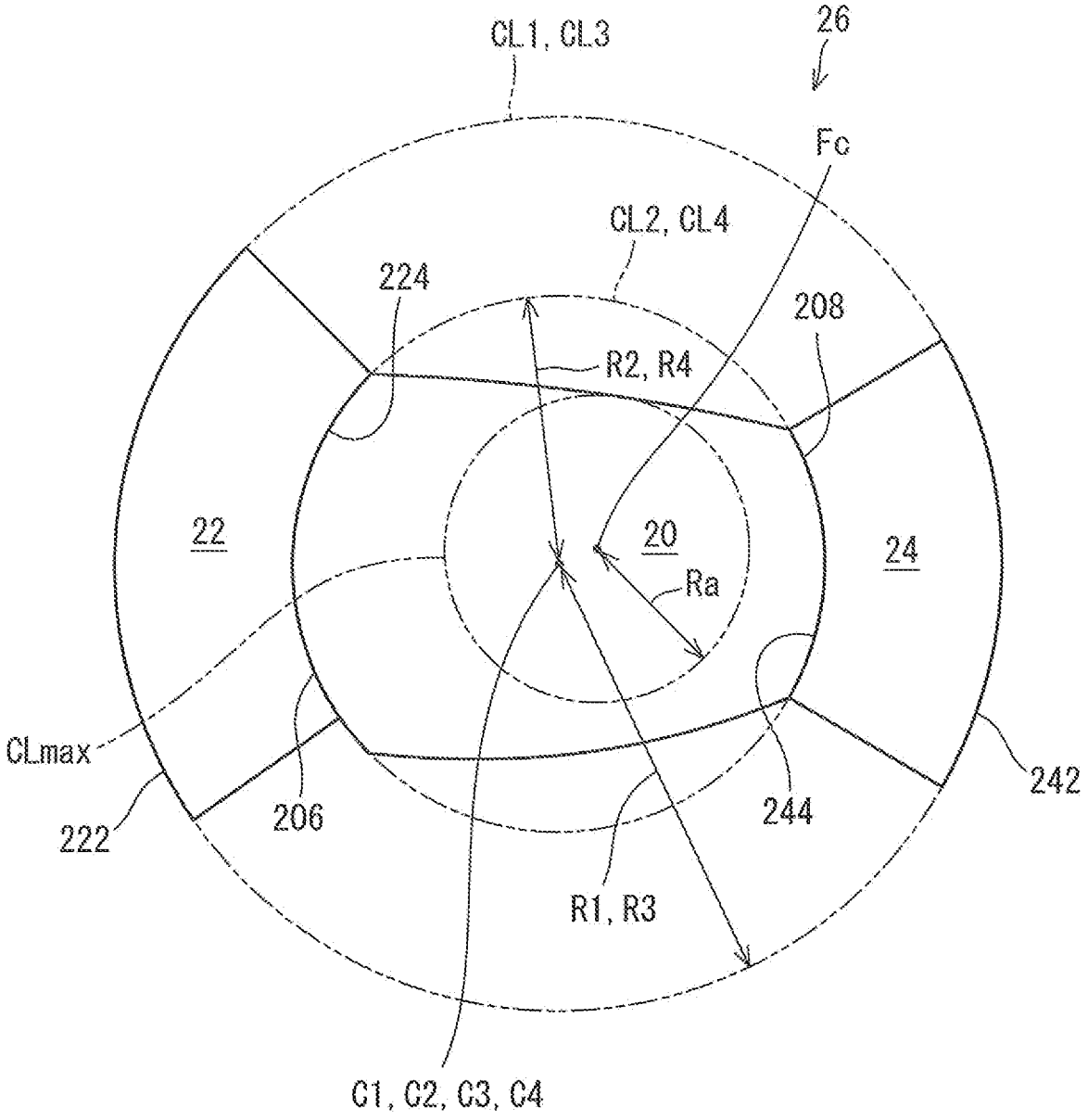
FIG. 6 is an enlarged view showing a face main part in FIG. 5.

FIG. 6 is an enlarged view of the face main part 26 in FIG. 5.

The face-peripheral contour line 222 of the toe thick-wall section 22 extends along a first circle CL1 that has its center C1 at the face center Fc or in the vicinity of the face center Fc. The first circle CL1 has a radius R1.

The face-central contour line 224 of the toe thick-wall section 22 extends along a second circle CL2 that has its center C2 at the face center Fc or in the vicinity of the face center Fc. The second circle CL2 has a radius R2. The radius R2 of the second circle CL2 is smaller than the radius R1 of the first circle CL1.

The face-peripheral contour line 242 of the heel thick-wall section 24 extends along a third circle CL3 that has its center C3 at the face center Fc or in the vicinity of the face center Fc. The third circle CL3 has a radius R3. In the present embodiment, the radius R3 is equal to the radius R1.

The face-central contour line 244 of the heel thick-wall section 24 extends along a fourth circle CL4 that has its center C4 at the face center Fc or in the vicinity of the face center Fc. The fourth circle CL4 has a radius R4 that is smaller than the radius R3 of the third circle CL3. In the present embodiment, the radius R4 is equal to the radius R2.

In the present embodiment, the first circle CL1 coincides with the third circle CL3. The first circle CL1 does not have to coincide with the third circle CL3. Considering a preferable configuration of the face central thin-wall section 20, the toe thick-wall section 22 and the heel thick-wall section 24, a ratio (R1/R3) of the radius R1 to the radius R3 is preferably greater than or equal to 0.90 and less than or equal to 1.10, more preferably greater than or equal to 0.92 and less than or equal to 1.08, and still more preferably greater than or equal to 0.94 and less than or equal to 1.06.

In the present embodiment, the center C1 coincides with the center C3. The center C1 does not have to coincide with the center C3. The center C1 and the center C3 are positioned at the face center Fc or in the vicinity of the face center Fc.

In the present embodiment, the second circle CL2 coincides with the fourth circle CL4. The second circle CL2 does not have to coincide with the fourth circle CL4. Considering a preferable configuration of the face central thin-wall section 20, the toe thick-wall section 22 and the heel thick-wall section 24, a ratio (R2/R4) of the radius R2 to the radius R4 is preferably greater than or equal to 0.90 and less than or equal to 1.10, more preferably greater than or equal to 0.92 and less than or equal to 1.08, and still more preferably greater than or equal to 0.94 and less than or equal to 1.06.

In the present embodiment, the center C2 coincides with the center C4. The center C2 does not have to coincide with the center C4. The center C2 and the center C4 are positioned at the face center Fc or in the vicinity of the face center Fc.

In the present embodiment, all the centers C1, C2, C3 and C4 coincide with each other. As described above, these centers do not have to coincide with each other.

As to the centers C1, C2, C3 and C4, the term "the vicinity of the face center Fc" means a region within a radius (distance in a straight line) of 5 mm from the face center Fc. Preferably, the term "the vicinity of the face center Fc" means a region within a radius of 4 mm from the face center Fc. More preferably, the term "the vicinity of the face center Fc" means a region within a radius of 3 mm from the face center Fc. In the present embodiment, neither the center C1, the center C2, the center C3 nor the center C4 does not coincide with the face center Fc. Alternatively, the centers C1, C2, C3 and C4 may coincide with the face center Fc.

As to the circles CL1, CL2, CL3 and CL4, the term "extends along a circle" means that a variation (error) of the distance from the center of the circle within the range from minus 5% to plus 5% is considered as a permitted tolerance. Accordingly, for example, when a circle CLa that has the same center as that of the circle CL1 and has a radius of 0.95×R1, and a circle CLb that has the same center as that of the circle CL1 and has a radius of 1.05×R1 are defined, a line that extends between the circle CLa and the circle CLb is considered as "extends along the circle CL1".

Figure 7:
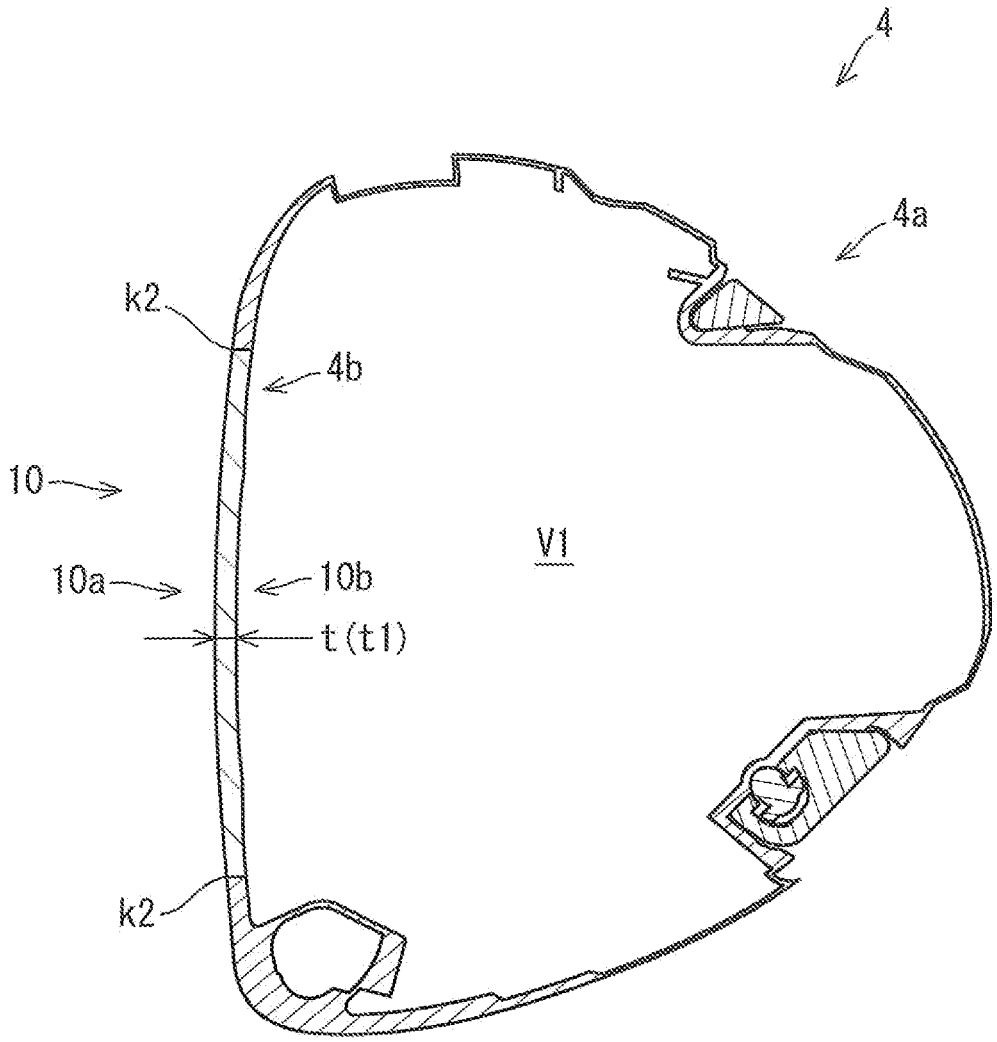
FIG. 7 is a cross-sectional view taken along line A-A in FIG. 2A.
Figure 8:
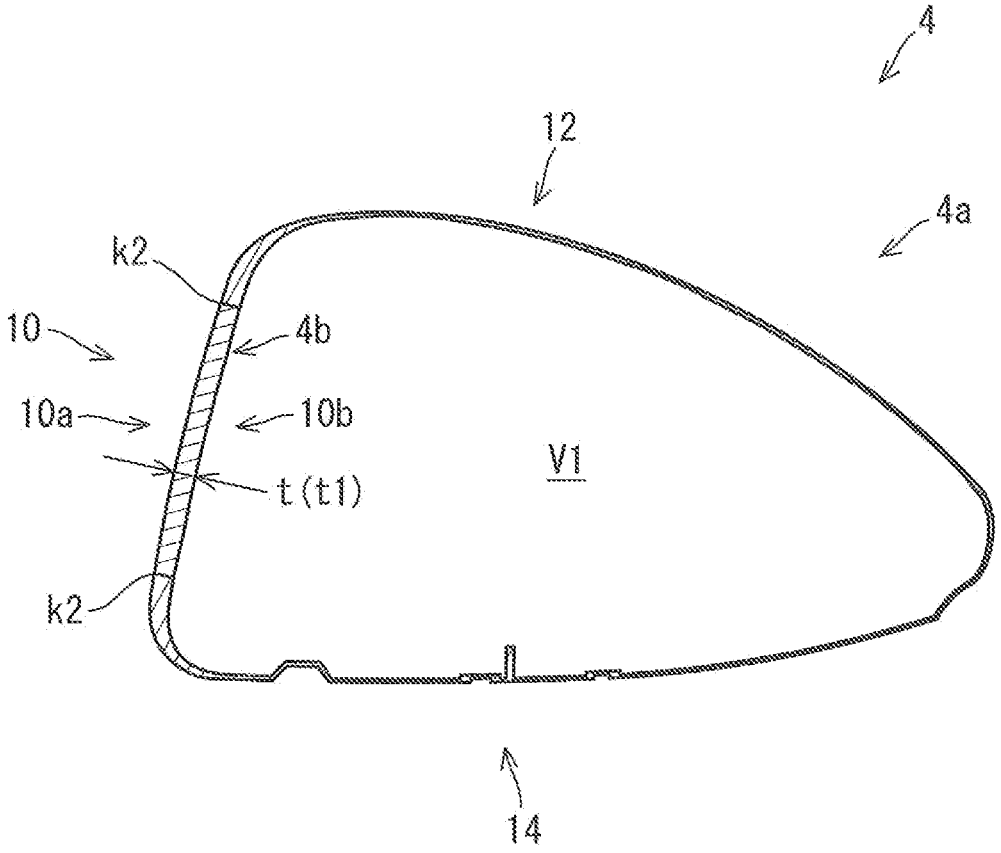
FIG. 8 is a cross-sectional view taken along line B-B in FIG. 2A.

FIG. 7 is a cross-sectional view taken along line A-A in FIG. 2A. FIG. 7 is an example of the horizontal cross section. FIG. 8 is a cross-sectional view taken along line B-B in FIG. 2A. FIG. 8 is an example of the vertical cross section.

The head 4 has a hollow part V1 inside the head 4. The face portion 10 includes the striking face 10*a* constituting the outer surface of the face portion 10, and a face inner surface 10*b* constituting the inner surface of the face portion 10. The face portion 10 has a face thickness t that is a distance between the striking face 10*a* and the face inner surface 10*b*. As described above, the face thickness t is also simply referred to as a thickness in the present disclosure. In the present disclosure, "thick" means that the face thickness t is thick. In the present disclosure, "thin" means that the face thickness t is thin. The face thickness t is measured in the direction of a line normal to the striking face 10*a*. Thicknesses t1 to t4 described below are examples of the face thickness t.

The body member 4*a* includes the entirety of the crown portion 12. The body member 4*a* includes the entirety of the sole portion 14. The body member 4*a* includes the entirety of the hosel portion 16. The body member 4*a* includes a part (peripheral part) of the face portion 10. The body member 4*a* has an opening, and the opening is covered by the face member 4*b*. The face member 4*b* is a plate-shaped member.

Figure 9:
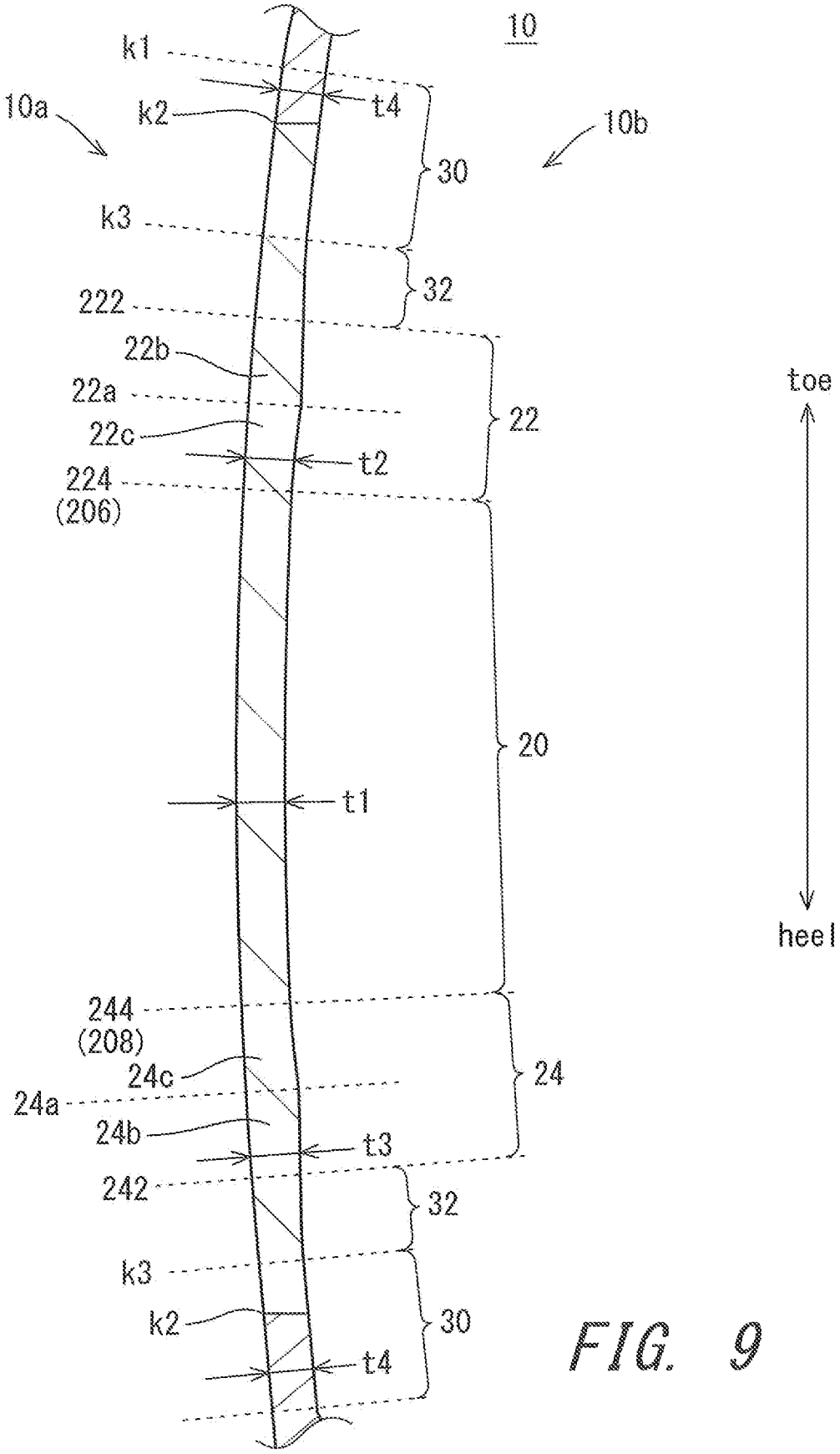
FIG. 9 is an enlarged view of the face portion shown in FIG. 7.
Figure 10:
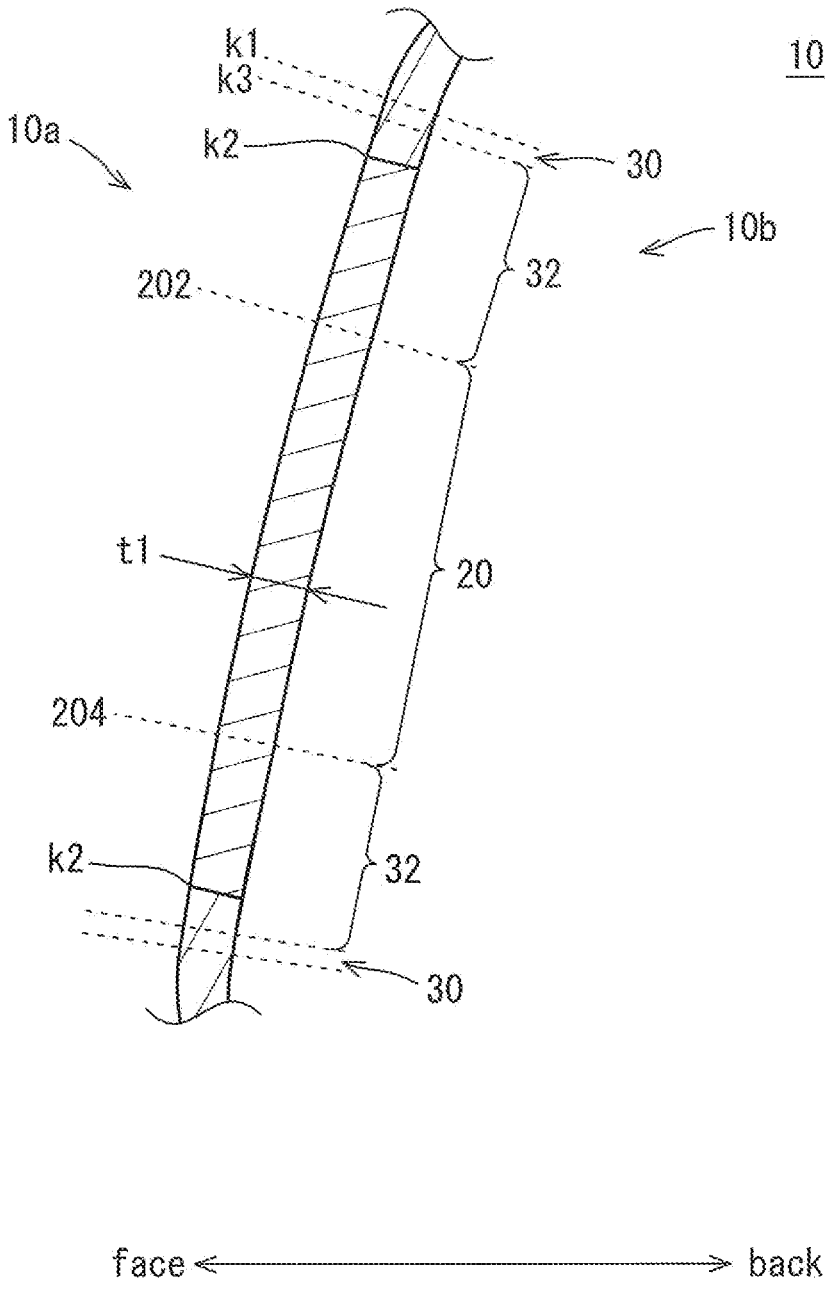
FIG. 10 is an enlarged view of the face portion shown in FIG. 8.

FIG. 9 is an enlarged view of the face portion in FIG. 7. FIG. 10 is an enlarged view of the face portion 10 in FIG. 8. FIG. 9 and FIG. 10 show contour lines of the sections/parts and positions of the outer edge with dashed lines.

The face central thin-wall section 20 has a thickness t1. In the present embodiment, the thickness t1 is constant. Alternatively, the thickness t1 may vary. The toe thick-wall section 22 has a thickness t2. In the present embodiment, the thickness t2 varies. Alternatively, the thickness t2 may be constant. The heel thick-wall section 24 has a thickness t3. In the present embodiment, the thickness t3 varies. Alternatively, the thickness t3 may be constant. The peripheral part 30 has a thickness t4. In the present embodiment, the thickness t4 is constant. Alternatively, the thickness t4 may vary.

The face central thin-wall section 20 is continuous with the toe thick-wall section 22 with no step. The face central thin-wall section 20 is continuous with the heel thick-wall section 24 with no step. The face central thin-wall section 20 is continuous with the transition part 32 with no step. The toe thick-wall section 22 is continuous with the transition part 32 with no step. The heel thick-wall section 24 is continuous with the transition part 32 with no step. The transition part 32 is continuous with the peripheral part 30 with no step. The entirety of the face inner surface 10*b* is formed with no step. Alternatively, the face inner surface 10*b* may have a step. For example, a step may be formed on a boundary between the sections/parts.

As shown in FIG. 9, the toe thick-wall section 22 has a mountain-shaped cross section. The toe thick-wall section 22 includes a maximum thickness part 22*a*. The thickness t2 of the toe thick-wall section 22 is at its maximum at the maximum thickness part 22*a*. The maximum thickness part 22*a* forms a peak on the face inner surface 10*b*. The maximum thickness part 22*a* forms a ridge line on the face inner surface 10*b*. The maximum thickness part 22*a* may have a width in the toe-heel direction. The maximum thickness part 22*a* extends in the up-down direction.

The toe thick-wall section 22 includes a first thickness varying part 22*b* that has a thickness t2 continuously decreasing from the maximum thickness part 22*a* toward the transition part 32. The first thickness varying part 22*b* is located on the toe side (a side closer to the periphery of the face portion 10) of the maximum thickness part 22*a*. The toe thick-wall section 22 includes a second thickness varying part 22*c* that has a thickness t2 continuously decreasing from the maximum thickness part 22*a* toward the face central thin-wall section 20. The second thickness varying part 22*c* is located on the heel side (a side closer to the central part of the face portion 10) of the maximum thickness part 22*a*.

As shown in FIG. 9, the heel thick-wall section 24 has a mountain-shaped cross section. The heel thick-wall section 24 includes a maximum thickness part 24*a*. The thickness t3 of the heel thick-wall section 24 is at its maximum at the maximum thickness part 24*a*. The maximum thickness part 24*a* forms a peak on the face inner surface 10*b*. The maximum thickness part 24*a* forms a ridge line on the face inner surface 10*b*. The maximum thickness part 24*a* may have a width in the toe-heel direction. The maximum thickness part 24*a* extends in the up-down direction.

The heel thick-wall section 24 includes a first thickness varying part 24*b* that has a thickness t3 continuously decreasing from the maximum thickness part 24*a* toward the transition part 32. The first thickness varying part 24*b* is located on the heel side (a side closer to the periphery of the face portion 10) of the maximum thickness part 24*a*. The heel thick-wall section 24 includes a second thickness varying part 24*c* that has a thickness t3 continuously decreasing from the maximum thickness part 24*a* toward the face central thin-wall section 20. The second thickness varying part 24*c* is located on the toe side (a side closer to the central part of the face portion 10) of the maximum thickness part 24*a*.

Figure 11:
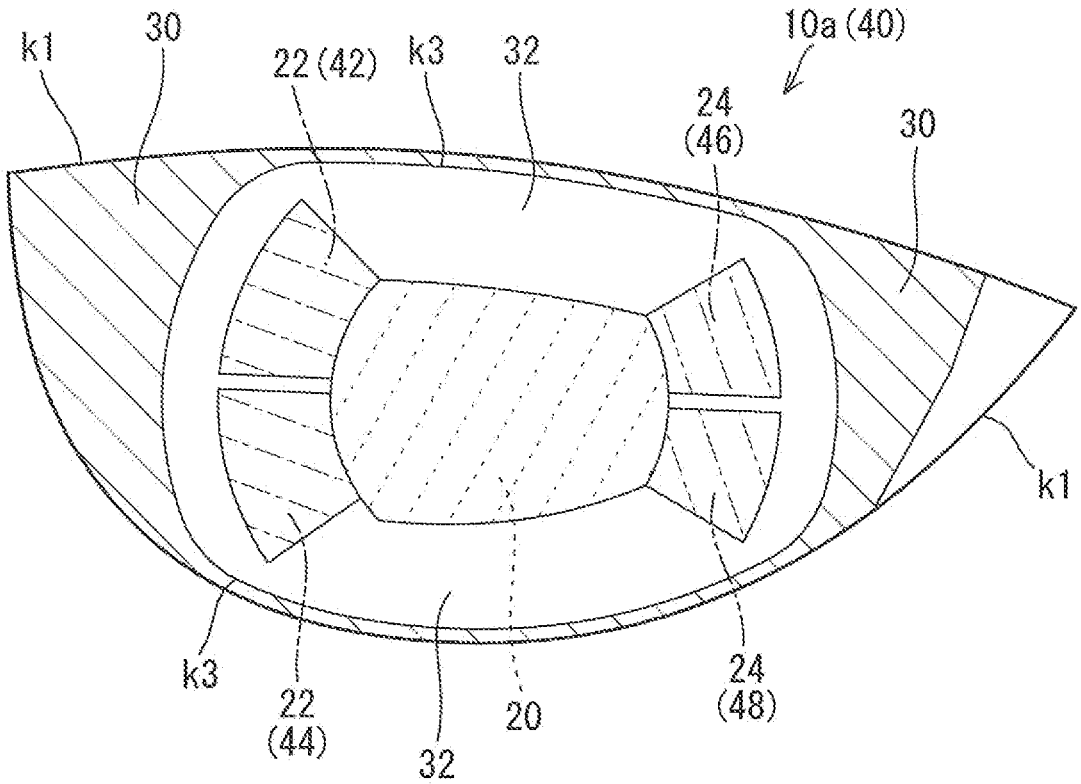
FIG. 11 shows a striking face in a front view of a head according to a second embodiment, and as with FIG. 5.

FIG. 11 shows a striking face 10*a* in the face front view of a head 40 according to a second embodiment. The head 40 includes a toe thick-wall section 22 and a heel thick-wall section 24 that are divided into their respective upper parts and their respective lower parts. Except for this point, the head 40 is the same as the head 4.

In the head 40, the toe thick-wall section 22 includes an upper part 42 and a lower part 44. The upper part 42 and the lower part 44 are located apart from each other. The upper part 42 includes a part that is located on the upper side with respect to the face center Fc. The lower part 44 includes a part that is located on the lower side with respect to the face center Fc. A part located between the upper part 42 and the lower part 44 belongs to the transition part 32. The part located between the upper part 42 and the lower part 44 is thinner than the toe thick-wall section 22. That is, the part located between the upper part 42 and the lower part 44 is thinner than each of the upper part 42 and the lower part 44.

In the head 40, the heel thick-wall section 24 includes an upper part 46 and a lower part 48. The upper part 46 and the lower part 48 are located apart from each other. The upper part 46 includes a part that is located on the upper side with respect to the face center Fc. The lower part 48 includes a part that is located on the lower side with respect to the face center Fc. A part located between the upper part 46 and the lower part 48 belongs to the transition part 32. The part located between the upper part 46 and the lower part 48 is thinner than the heel thick-wall section 24. That is, the part located between the upper part 46 and the lower part 48 is thinner than each of the upper part 46 and the lower part 48.

The heads 4 and 40 of the respective embodiments exhibit the following advantageous effects.

The face central thin-wall section 20 that strikes balls is made thin, which can effectively bend the striking portion, and can enhance the rebound performance of the striking portion. The face central portion is thinner than the face peripheral portion, which can most effectively bend the central portion which is the striking region, thereby improving the rebound performance. A local bending of only the striking region can reduce strength. The presence of the toe thick-wall section 22 and the heel thick-wall section 24, however, can prevent such a local bending of only the striking region. Accordingly, these heads can enhance the rebound performance of the striking region and improve the durability of the face portion 10.

Neither the toe thick-wall section 22 nor the heel thick-wall section 24 reaches the outer edge k1 of the face portion 10. For this reason, these thick-wall sections cannot hamper bending of the peripheral region of the face portion 10. In addition, the toe thick-wall section 22 and the heel thick-wall section 24 enhance the rigidity of the surrounding region of the face central thin-wall section 20, which can prevent concentration of bending in the face central region and can expand bending to the face peripheral region. Such an expansion of bending causes the bending of the face peripheral region, which can bend the entirety of the face portion 10. This can improve the durability of the face portion 10, and can maintain or improve the rebound performance.

The up-down directional length W1 of the toe thick-wall section 22 (see FIG. 4) is not limited. From the viewpoint of expanding a bending region of the face portion 10, the up-down directional length W1 is preferably greater than or equal to 10 mm, more preferably greater than or equal to 15 mm, and still more preferably greater than or equal to 20 mm. From the viewpoint of preventing the toe thick-wall section 22 from reaching the outer edge k1 of the face portion 10, the up-down directional length W1 is preferably less than or equal to 40 mm, more preferably less than or equal to 38 mm, and still more preferably less than or equal to 36 mm. When the toe thick-wall section 22 is divided into a plurality of parts as in the embodiment of FIG. 11, the up-down directional length W1 is the sum of respective up-down directional lengths of the divided parts.

The up-down directional length W3 of the heel thick-wall section 24 (see FIG. 4) is not limited. From the viewpoints of preventing a local bending of the face central thin-wall section 20 and expanding the bending region, the up-down directional length W3 is preferably greater than or equal to 10 mm, more preferably greater than or equal to 12 mm, and still more preferably greater than or equal to 14 mm. From the viewpoint of preventing the heel thick-wall section 24 from reaching the outer edge k1 of the face portion 10, the up-down directional length W3 is preferably less than or equal to 34 mm, more preferably less than or equal to 32 mm, and still more preferably less than or equal to 30 mm. When the heel thick-wall section 24 is divided into a plurality of parts as in the embodiment of FIG. 11, the up-down directional length W3 is the sum of respective up-down directional lengths of the divided parts.

The double-pointed arrow Wf in FIG. 3 shows the up-down directional width Wf of the striking face 10*a*. From the viewpoints of preventing a local bending of the face central thin-wall section 20 and expanding the bending region, a proportion of the up-down directional length W1 of the toe thick-wall section 22 to the up-down directional width Wf is preferably greater than or equal to 50%, more preferably greater than or equal to 55%, and still more preferably greater than or equal to 60%. From the viewpoint of preventing the toe thick-wall section 22 from reaching the outer edge k1 of the face portion 10, the proportion of the up-down directional length W1 to the up-down directional width Wf is preferably less than or equal to 90%, more preferably less than or equal to 85%, and still more preferably less than or equal to 80%.

From the viewpoints of preventing a local bending of the face central thin-wall section 20 and expanding the bending region, a proportion of the up-down directional length W3 of the heel thick-wall section 24 to the up-down directional width Wf is preferably greater than or equal to 50%, more preferably greater than or equal to 55%, and still more preferably greater than or equal to 60%. From the viewpoint of preventing the heel thick-wall section 24 from reaching the outer edge k1 of the face portion 10, the proportion of the up-down directional length W3 to the up-down directional width Wf is preferably less than or equal to 90%, more preferably less than or equal to 85%, and still more preferably less than or equal to 80%.

As to the toe thick-wall section 22, if the toe-heel directional length W2 is excessively long relative to the up-down directional length W1, the toe thick-wall section 22 is located closer to the toe-side end of the face portion 10, which can reduce the bending of the toe thick-wall section 22. From this viewpoint, W2/W1 is preferably less than or equal to 0.50, more preferably less than or equal to 0.48, and still more preferably less than or equal to 0.46. If the toe-heel directional length W2 is excessively short relative to the up-down directional length W1, the advantageous effect of expanding the bending region can be reduced. From this viewpoint, W2/W1 is preferably greater than or equal to 0.38, more preferably greater than or equal to 0.40, and still more preferably greater than or equal to 0.42.

As to the heel thick-wall section 24, if the toe-heel directional length W4 is excessively long relative to the up-down directional length W3, the heel thick-wall section 24 is located closer to the heel-side end of the face portion 10, which can reduce the bending of the heel thick-wall section 24. From this viewpoint, W4/W3 is preferably less than or equal to 0.54, more preferably less than or equal to 0.52, and still more preferably less than or equal to 0.50. If the toe-heel directional length W4 is excessively short relative to the up-down directional length W3, the advantageous effect of expanding the bending region can be reduced. From this viewpoint, W4/W3 is preferably greater than or equal to 0.40, more preferably greater than or equal to 0.42, and still more preferably greater than or equal to 0.44.

As shown in FIG. 6, the face central thin-wall section 20 includes a circle CLmax that is a largest circle under the conditions that the circle CLmax has its center at the face center Fc and the entirety of the circle CLmax is contained in the face central thin-wall section 20. From the viewpoint of enhancing rebound performance, the circle CLmax has a radius Ra of preferably greater than or equal to 5 mm, more preferably greater than or equal to 6 mm, and still more preferably greater than or equal to 7 mm. From the viewpoint of strength, the radius Ra of the circle CLmax is preferably less than or equal to 12 mm, more preferably less than or equal to 11 mm, and still more preferably less than or equal to 10 mm.

As shown in FIG. 5, the face central thin-wall section 20 has an area S1. The toe thick-wall section 22 has an area S2. The heel thick-wall section 24 has an area S3. The peripheral part 30 has an area S4. The striking face 10*a* has an area S10. The area S10 of the striking face 10*a* is the area of a figure indicated by the outer edge k1 of the face portion 10.

An excessively large toe thick-wall section 22 relative to the face central thin-wall section 20 can lead to reduced bending. From this viewpoint, S2/S1 is preferably less than or equal to 0.60, more preferably less than or equal to 0.58, still more preferably less than or equal to 0.56, and yet more preferably less than or equal to 0.54. An excessively small toe thick-wall section 22 relative to the face central thin-wall section 20 can reduce the advantageous effect of expanding the bending region. From this viewpoint, S2/S1 is preferably greater than or equal to 0.40, more preferably greater than or equal to 0.44, still more preferably greater than or equal to 0.46, and yet more preferably greater than or equal to 0.48.

An excessively large heel thick-wall section 24 relative to the face central thin-wall section 20 can lead to reduced bending. From this viewpoint, S3/S1 is preferably less than or equal to 0.48, more preferably less than or equal to 0.44, still more preferably less than or equal to 0.42, and yet more preferably less than or equal to 0.40. An excessively small heel thick-wall section 24 relative to the face central thin-wall section 20 can reduce the advantageous effect of expanding the bending region. From this viewpoint, S3/S1 is preferably greater than or equal to 0.30, more preferably greater than or equal to 0.32, still more preferably greater than or equal to 0.34, and yet more preferably greater than or equal to 0.36.

A ratio (S1/S10) of the area S1 to the area S10 of the striking face 10*a* can be considered. From the viewpoint of rebound performance, S1/S10 is preferably greater than or equal to 0.15, more preferably greater than or equal to 0.16, and still more preferably greater than or equal to 0.17. Considering strength and configuration of the toe thick-wall section 22 and the heel thick-wall section 24, S1/S10 is preferably less than or equal to 0.30, more preferably less than or equal to 0.25, and still more preferably less than or equal to 0.20.

From the viewpoint of enhancing rebound performance, the area S1 of the face central thin-wall section 20 is preferably greater than or equal to 460 $mm^2$, more preferably greater than or equal to 480 $mm^2$, still more preferably greater than or equal to 500 $mm^2$, still more preferably greater than or equal to 520 $mm^2$, and yet more preferably greater than or equal to 540 $mm^2$. From the viewpoint of strength, the area S1 is preferably less than or equal to 700 $mm^2$, more preferably less than or equal to 650 $mm^2$, and still more preferably less than or equal to 600 $mm^2$.

The peripheral part 30 has an area S4, and facilitates the bending of the face peripheral region. From the viewpoint of expanding the bending region to bend the entirety of the face, S4/S10 is preferably greater than or equal to 0.15, more preferably greater than or equal to 0.20, and still more preferably greater than or equal to 0.25. From the viewpoint of having a sufficient area of the face main part 26, S4/S10 is preferably less than or equal to 0.40, more preferably less than or equal to 0.35, and still more preferably less than or equal to 0.30.

From the viewpoint of rebound performance, the thickness t1 of the face central thin-wall section is preferably less than or equal to 3.2 mm, more preferably less than or equal to 3.1 mm, still more preferably less than or equal to 3.0 mm, still more preferably less than or equal to 2.9 mm, and yet more preferably less than or equal to 2.8 mm. From the viewpoint of strength, the thickness t1 is preferably greater than or equal to 2.2 mm, more preferably greater than or equal to 2.4 mm, and still more preferably greater than or equal to 2.6 mm.

From the viewpoint of expanding the bending region, the thickness t2 of the toe thick-wall section 22 is preferably greater than or equal to 2.8 mm, more preferably greater than or equal to 2.9 mm, still more preferably greater than or equal to 3.0 mm, and yet more preferably greater than or equal to 3.1 mm. From the viewpoint of weight reduction of the face portion 10, the thickness t2 is preferably less than or equal to 3.8 mm, more preferably less than or equal to 3.6 mm, and still more preferably less than or equal to 3.4 mm.

From the viewpoint of expanding the bending region, the maximum value of the thickness t2 of the toe thick-wall section 22 is preferably greater than or equal to 2.9 mm, more preferably greater than or equal to 3.0 mm, and still more preferably greater than or equal to 3.1 mm. From the viewpoint of weight reduction of the face portion 10, the maximum value of the thickness t2 is preferably less than or equal to 3.9 mm, more preferably less than or equal to 3.7 mm, and still more preferably less than or equal to 3.5 mm.

From the viewpoint of expanding the bending region, the thickness t3 of the heel thick-wall section 24 is preferably greater than or equal to 2.8 mm, more preferably greater than or equal to 2.9 mm, still more preferably greater than or equal to 3.0 mm, and yet more preferably greater than or equal to 3.1 mm. From the viewpoint of weight reduction of the face portion 10, the thickness t3 is preferably less than or equal to 3.8 mm, more preferably less than or equal to 3.6 mm, and still more preferably less than or equal to 3.4 mm.

From the viewpoint of expanding the bending region, the maximum value of the thickness t3 of the heel thick-wall section 24 is preferably greater than or equal to 2.9 mm, more preferably greater than or equal to 3.0 mm, and still more preferably greater than or equal to 3.1 mm. From the viewpoint of weight reduction of the face portion 10, the maximum value of the thickness t3 is preferably less than or equal to 3.9 mm, more preferably less than or equal to 3.7 mm, and still more preferably less than or equal to 3.5 mm.

The maximum value of the thickness t2 of the toe thick-wall section 22 is denoted by t2max, and the face thickness at the face center Fc is denoted by tc. From the viewpoints of obtaining a larger bending of the face central thin-wall section 20, preventing a local bending of only the thin-wall section 20, and expanding the bending region, it is preferable that the maximum value of the thickness t2 of the toe thick-wall section 22 is 0.2 mm or more greater than the face thickness at the face center Fc. That is, a difference (t2max−tc) is preferably greater than or equal to 0.2 mm. From this viewpoint, the difference (t2max−tc) is more preferably greater than or equal to 0.25 mm, and still more preferably greater than or equal to 0.3 mm. Considering the preferable ranges of the thickness t2 and the thickness t1, the difference (t2max−tc) is preferably less than or equal to 0.7 mm, more preferably less than or equal to 0.6 mm, and still more preferably less than or equal to 0.5 mm.

The maximum value of the thickness t3 of the heel thick-wall section 24 is denoted by t3max, and the face thickness at the face center Fc is denoted by tc. From the viewpoints of obtaining a larger bending of the face central thin-wall section 20, preventing a local bending of only the thin-wall section 20, and expanding the bending region, it is preferable that the maximum value of the thickness t3 of the heel thick-wall section 24 is 0.2 mm or more greater than the face thickness at the face center Fc. That is, a difference (t3max−tc) is preferably greater than or equal to 0.2 mm. From this viewpoint, the difference (t3max−tc) is more preferably greater than or equal to 0.25 mm, and still more preferably greater than or equal to 0.3 mm. Considering the preferable ranges of the thickness t3 and the thickness t1, the difference (t3max−tc) is preferably less than or equal to 0.7 mm, more preferably less than or equal to 0.6 mm, and still more preferably less than or equal to 0.5 mm.

As shown in FIG. 4, the toe thick-wall section 22 is located apart from the heel thick-wall section 24. Such a configuration in which the toe thick-wall section 22 is apart from the heel thick-wall section 24 does not restrict bending in the face central thin-wall section 20 and does effectively expand the bending region. From this viewpoint, a distance D1 between the toe thick-wall section 22 and the heel thick-wall section 24 is preferably greater than or equal to 20 mm, more preferably greater than or equal to 21 mm, and still more preferably greater than or equal to 22 mm. Considering the preferable area of the face central thin-wall section 20, the distance D1 is preferably less than or equal to 40 mm, more preferably less than or equal to 35 mm, and still more preferably less than or equal to 30 mm. The distance D1 is measured in the toe-heel direction. The distance D1 is the distance between the point Ti and the point Hi in the toe-heel direction.

A portion that is thicker than the face central thin-wall section 20 is not provided between the toe thick-wall section 22 and the heel thick-wall section 24. That is, a portion that is thicker than the face central thin-wall section 20 is not present in the toe-heel directional region of the distance D1. The face portion 10 has a width in the horizontal direction (toe-heel direction) greater than its width in the vertical direction (up-down direction). By disposing the thick-wall sections only on the toe side and heel side of the face central thin-wall section 20, bending can be expanded to a larger region while avoiding restricting bending in the face center region.

If a gap (for example, a thinner portion) is present between the toe thick-wall section 22 and the face central thin-wall section 20, stress is centered and concentrated at the gap, which can result in deterioration of durability. In the heads 4 and 40, the toe thick-wall section 22 is continuous with the face central thin-wall section 20, and thus such a deterioration of durability cannot occur.

If a gap (for example, a thinner portion) is present between the heel thick-wall section 24 and the face central thin-wall section 20, stress is centered and concentrated at the gap, which can result in deterioration of durability. In the heads 4 and 40, the heel thick-wall section 24 is continuous with the face central thin-wall section 20, and thus such a deterioration of durability cannot occur.

EXAMPLES

Example 1

A head having the same configuration as the head 4 of the first embodiment was produced. The materials of the body member 4*a* and the face member 4*b* were titanium alloys. The body member 4*a* was produced by lost-wax precision casting. The face member 4*b* was produced by forging. The body member 4*a* and the face member b4 were welded to each other to obtain a head of Example 1. A shaft and a grip were attached to the obtained head to obtain a golf club of Example 1.

Example 2

A head and a golf club of Example 2 were obtained in the same manner as in Example 1 except that the head 4 was replaced with the head 40 (FIG. 11) of the second embodiment in which the toe thick-wall section 22 and the heel thick-wall section 24 were divided into their respective upper parts and their respective lower parts.

Examples 3 to 7

Heads and golf clubs of Examples 3 to 7 were obtained in the same manner as in Example 1 except that respective thicknesses of sections/parts were set as shown in Table 1.

Comparative Example 1

A head and a golf club of Comparative Example 1 were obtained in the same manner as in Example 1 except that the thickness of a region corresponding to the face central thin-wall section 20 in Example 1 was changed to 3.1 mm, and the thicknesses of regions corresponding to the toe thick-wall section 22 and the heel thick-wall section 24 in Example 1 were changed to 2.8 mm.

Comparative Example 2

A head and a golf club of Comparative Example 2 were obtained in the same manner as in Example 1 except that the thickness of a region corresponding to the face central thin-wall section 20 in Example 1 was changed to 2.8 mm, and the thicknesses of regions corresponding to the toe thick-wall section 22 and the heel thick-wall section 24 in Example 1 were changed also to 2.8 mm.

Comparative Example 3

Figure 12:
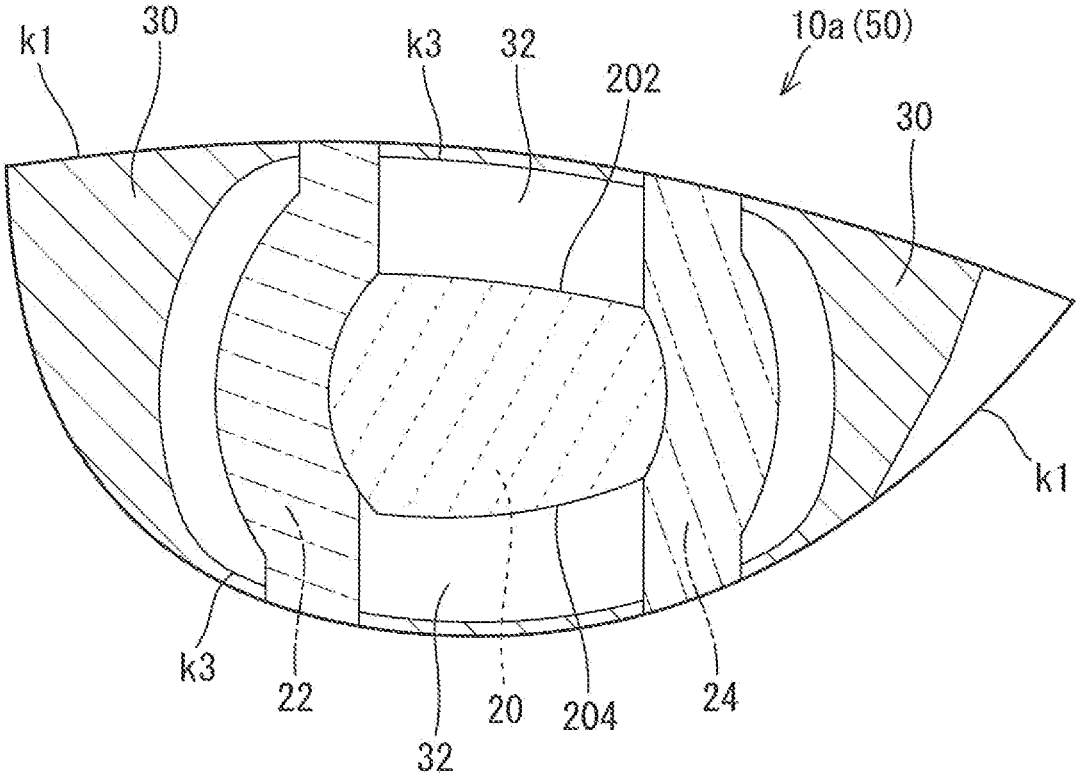
FIG. 12 shows a striking face in a front view of a head of Comparative Example 3.

FIG. 12 shows a striking face 10*a* in the face front view of a head 50 of Comparative Example 3. In the head 50, the toe thick-wall section 22 is lengthened upward and downward so that its upper end and its lower end reach the outer edge k1 of the face portion 10. In addition, the heel thick-wall section 24 is lengthened upward and downward so that its upper end and its lower end reach the outer edge k1 of the face portion 10. Except for these configurations, the head 50 is the same as the head 4. A head and a golf club of Comparative Example 3 were obtained in the same manner as in Example 1 except that the head 4 in Example 1 was replaced with the head 50 including the lengthened toe thick-wall section 22 and the lengthened heel thick-wall section 24.

Specifications and evaluation results of Examples 1 to 7 are shown in below Table 1. Specifications and evaluation results of Comparative Examples 1 to 3 are shown in below Table 2. Since thicknesses were changed as described above in Comparative Examples 1 and 2, neither the face central thin-wall section, the toe thick-wall section, nor the heel thick-wall section is present. However, for the sake of easy comparison between Examples in Table 1 and Comparative Examples in Table 2, row labels in Table 2 are the same as row labels in Table 1.

[Flight Distance]

Each golf club was attached to a swing robot, and the swing robot struck balls with the club at a head speed of 45 m/s to measure flight distances of the struck balls. The striking point was at the face center Fc. The flight distance is a total flight distance that includes run. As the balls, the trade name "SRIXON Z-STAR XV" manufactured by Sumitomo Rubber Industries, Ltd. was used. The swing robot struck five balls with each club. Average values of flight distances of the five balls for respective clubs are shown in the below Tables 1 and 2.

[Durability]

Each golf club was attached to a swing robot, and the swing robot struck two-piece balls with the club at a head speed of 50 m/s. The striking point was at the face center Fc. The face surface was elaborately examined after every 50 strokes to determine whether damage such as a crack was found. When damage was found, the swing robot stopped striking balls. When no damage occurred after 5000 strokes, the swing robot stopped striking balls at 5000 strokes. The numbers of strokes made until the swing robot stopped striking balls are shown in Tables 1 and 2 below.

TABLE 1

Specifications and evaluation results of Examples

| | Unit | Example 1 | Example 2 | Example 3 | Example 4 | Example 5 | Example 6 | Example 7 |
|---|---|---|---|---|---|---|---|---|
| Corresponding drawing | — | FIG. 5 | FIG. 11 | FIG. 5 | FIG. 5 | FIG. 5 | FIG. 5 | FIG. 5 |
| Thickness t1 of the face central thin-wall section 20 | mm | 2.8 | 2.8 | 2.8 | 2.8 | 2.9 | 3.2 | 3.3 |
| Thickness at the face center Fc | mm | 2.8 | 2.8 | 2.8 | 2.8 | 2.9 | 3.2 | 3.3 |
| Thisness t2 (maximum value) of the toe thick-wall section 22 | mm | 3.1 | 3.1 | 3.0 | 2.9 | 3.1 | 3.3 | 3.4 |
| Thickness t3 (maximum value) of the heel thick-wall section 24 | mm | 3.1 | 3.1 | 3.0 | 2.9 | 3.1 | 3.3 | 3.4 |
| Thickness t4 of the peripheral part 30 | mm | 2.6 | 2.6 | 2.6 | 2.6 | 2.6 | 2.6 | 2.6 |
| Flight distance | yard | 266.0 | 268.0 | 270.0 | 271.0 | 263.0 | 260.0 | 257.0 |
| Durability | number of strokes | 5000 strokes finished | 5000 strokes finished | 5000 strokes finished | 5000 strokes finished | 5000 strokes finished | 5000 strokes finished | 5000 strokes finished |

TABLE 2

Specifications and evaluation results of Comparative Examples

| | Unit | Comparative Example 1 | Comparative Example 2 | Comparative Example 3 |
|---|---|---|---|---|
| Corresponding drawing | — | — | — | FIG. 12 |
| Thickness t1 of the face central thin-wall section 20 | mm | 3.1 | 2.8 | 2.8 |
| Thickness at the face center Fc | mm | 3.1 | 2.8 | 2.8 |
| Thisness t2 (maximum value) of the toe thick-wall section 22 | mm | 2.8 | 2.8 | 3.1 |
| Thickness t3 (maximum value) of the heel thick-wall section 24 | mm | 2.8 | 2.8 | 3.1 |
| Thickness t4 of the peripheral part 30 | mm | 2.6 | 2.6 | 2.6 |
| Flight distance | yard | 261.0 | 272.0 | 248.0 |
| Durability | number of strokes | 3800 | 3200 | 5000 strokes finished |

As shown in Table 1 and Table 2, Examples are highly evaluated as compared with Comparative Examples. Advantages of the present disclosure are clear.

Regarding the above-described embodiments, the following clauses are disclosed.

[Clause 1]

A golf club head including:

a face portion;

a crown portion;

a sole portion; and a hosel portion, wherein the face portion includes a striking face that constitutes an outer surface of the face portion, a face inner surface that constitutes an inner surface of the face portion, and a face thickness that is defined as a distance between the striking face and the face inner surface, the striking face includes a face center, the face portion includes: as a distribution of the face thickness, a face central thin-wall section that includes the face center; a toe thick-wall section that is thicker than the face central thin-wall section, that is positioned spaced 8 mm or more apart from the face center toward a toe side, and that extends in an up-down direction; and a heel thick-wall section that is thicker than the face central thin-wall section, that is positioned spaced 8 mm or more apart from the face center toward a heel side, and that extends in the up-down direction, the toe thick-wall section extends to a position that does not reach an outer edge of the face portion, and the heel thick-wall section extends to a position that does not reach the outer edge of the face portion.

[Clause 2]

The golf club head according to clause 1, wherein the toe thick-wall section is contiguous with a toe side of the face central thin-wall section, and the heel thick-wall section is contiguous with a heel side of the face central thin-wall section.

[Clause 3]

The golf club head according to clause 1 or 2, wherein a proportion of an up-down directional length of the toe thick-wall section to an up-down directional width of the striking face is greater than or equal to 50% and less than or equal to 90%, and a proportion of an up-down directional length of the heel thick-wall section to the up-down directional width of the striking face is greater than or equal to 50% and less than or equal to 90%.

[Clause 4]

The golf club head according to any one of clauses 1 to 3, wherein a maximum value of the face thickness in the toe thick-wall section and a maximum value of the face thickness in the heel thick-wall section are 0.2 mm or more greater than the face thickness at the face center.

[Clause 5]

The golf club head according to any one of clauses 1 to 4, wherein the face thickness of the face central thin-wall section is less than or equal to 3.2 mm.

[Clause 6]

The golf club head according to any one of clauses 1 to 5, wherein the toe thick-wall section has a face-peripheral contour line, the face-peripheral contour line extending along a first circle that has its center at the face center or in a vicinity of the face center, the toe thick-wall section has a face-central contour line, the face-central contour line extending along a second circle that has its center at the face center or in the vicinity of the face center and that has a radius smaller than a radius of the first circle, the heel thick-wall section has a face-peripheral contour line, the face-peripheral contour line extending along a third circle that has its center at the face center or in the vicinity of the face center, and the heel thick-wall section has a face-central contour line, the face-central contour line extending along a fourth circle that has its center at the face center or in the vicinity of the face center and that has a radius smaller than a radius of the third circle.

LIST OF REFERENCE SYMBOLS

2 Golf club
4, 40, 50 Head
4*a* Body member of the head
4*b* Face member
6 Shaft
8 Grip
10 Face portion
10*a* Striking face
10*b* Face inner surface
12 Crown portion
14 Sole portion
20 Face central thin-wall section
202 Upper contour line of the face central thin-wall section
204 Lower contour line of the face central thin-wall section
206 Toe-side contour line of the face central thin-wall section
208 Heel-side contour line of the face central thin-wall section
22 Toe thick-wall section
222 Face-peripheral contour line of the toe thick-wall section
224 Face-central contour line of the toe thick-wall section
24 Heel thick-wall section
242 Face-peripheral contour line of the heel thick-wall section
244 Face-central contour line of the heel thick-wall section
26 Face main part
Peripheral part
32 Transition part
k1 Outer edge of the face portion
k2 Boundary between the body member and the face member
k3 Outer peripheral contour line of the transition part
Fc Face center
V1 Hollow part
Fe Outer edge of the striking face
Z Shaft axis line
SS Sweet spot The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a face portion;

a crown portion;

a sole portion; and a hosel portion, wherein the face portion includes a striking face that constitutes an outer surface of the face portion, a face inner surface that constitutes an inner surface of the face portion, and a face thickness that is defined as a distance between the striking face and the face inner surface, the striking face includes a face center, the face portion includes: as a distribution of the face thickness, a face central thin-wall section that includes the face center; a toe thick-wall section that is thicker than the face central thin-wall section, that is positioned spaced 8 mm or more apart from the face center toward a toe side, and that extends in an up-down direction; and a heel thick-wall section that is thicker than the face central thin-wall section, that is positioned spaced 8 mm or more apart from the face center toward a heel side, and that extends in the up-down direction, the toe thick-wall section extends to a position that does not reach an outer edge of the face portion, the heel thick-wall section extends to a position that does not reach the outer edge of the face portion, a proportion of an up-down directional length of the toe thick-wall section to an up-down directional width of the striking face is greater than or equal to 50% and less than or equal to 90%, and a proportion of an up-down directional length of the heel thick-wall section to the up-down directional width of the striking face is greater than or equal to 50% and less than or equal to 90%.

2. The golf club head according to claim 1, wherein the toe thick-wall section is contiguous with a toe side of the face central thin-wall section, and the heel thick-wall section is contiguous with a heel side of the face central thin-wall section.

3. The golf club head according to claim 1, wherein a maximum value of the face thickness in the toe thick-wall section and a maximum value of the face thickness in the heel thick-wall section are 0.2 mm or more greater than the face thickness at the face center.

4. The golf club head according to claim 1, wherein the face thickness of the face central thin-wall section is less than or equal to 3.2 mm.

5. The golf club head according to claim 1, wherein the toe thick-wall section has a face-peripheral contour line, the face-peripheral contour line extending along a first circle that has its center at the face center or in a vicinity of the face center, the toe thick-wall section has a face-central contour line, the face-central contour line extending along a second circle that has its center at the face center or in the vicinity of the face center and that has a radius smaller than a radius of the first circle, the heel thick-wall section has a face-peripheral contour line, the face-peripheral contour line extending along a third circle that has its center at the face center or in the vicinity of the face center, and the heel thick-wall section has a face-central contour line, the face-central contour line extending along a fourth circle that has its center at the face center or in the vicinity of the face center and that has a radius smaller than a radius of the third circle.

6. The golf club head according to claim 1, wherein the up-down directional width of the striking face is measured at a position of the face center.

7. The golf club head according to claim 6, wherein when the up-down directional length of the toe thick-wall section is denoted by W1, and a toe-heel directional length of the toe thick-wall section is denoted by W2, then W2/W1 is greater than or equal to 0.38 and less than or equal to 0.50, and when the up-down directional length of the heel thick-wall section is denoted by W3, and a toe-heel directional length of the heel thick-wall section is denoted by W4, then W4/W3 is greater than or equal to 0.40 and less than or equal to 0.54.

8. The golf club head according to claim 1, wherein the face thickness of the toe thick-wall section is greater than or equal to 2.8 mm and less than or equal to 3.8 mm, and the face thickness of the heel thick-wall section is greater than or equal to 2.8 mm and less than or equal to 3.8 mm.

9. The golf club head according to claim 1, wherein a distance between the toe thick-wall section and the heel thick-wall section in a toe-heel direction is greater than or equal to 20 mm and less than or equal to 40 mm.

10. A golf club head comprising:

a face portion;

a crown portion;

a sole portion; and a hosel portion, wherein the face portion includes a striking face that constitutes an outer surface of the face portion, a face inner surface that constitutes an inner surface of the face portion, and a face thickness that is defined as a distance between the striking face and the face inner surface, the striking face includes a face center, the face portion includes: as a distribution of the face thickness, a face central thin-wall section that includes the face center; a toe thick-wall section that is thicker than the face central thin-wall section, that is positioned spaced 8 mm or more apart from the face center toward a toe side, and that extends in an up-down direction; and a heel thick-wall section that is thicker than the face central thin-wall section, that is positioned spaced 8 mm or more apart from the face center toward a heel side, and that extends in the up-down direction, the toe thick-wall section extends to a position that does not reach an outer edge of the face portion, the heel thick-wall section extends to a position that does not reach the outer edge of the face portion, a proportion of an up-down directional length of the toe thick-wall section to an up-down directional width of the striking face is greater than or equal to 50% and less than or equal to 90%, a proportion of an up-down directional length of the heel thick-wall section to the up-down directional width of the striking face is greater than or equal to 50% and less than or equal to 90%, when the face central thin-wall section has an area that is denoted by S1, the toe thick-wall section has an area that is denoted by S2, and the heel thick-wall section has an area that is denoted by S3, then S2/S1 is greater than or equal to 0.48 and less than or equal to 0.60, and S3/S1 is greater than or equal to 0.36 and less than or equal to 0.48.

11. The golf club head according to claim 10, wherein when the striking face has an area that is denoted by S10, S1/S10 is greater than or equal to 0.15 and less than or equal to 0.30.

12. The golf club head according to claim 10, wherein the toe thick-wall section is contiguous with a toe side of the face central thin-wall section, and the heel thick-wall section is contiguous with a heel side of the face central thin-wall section.

13. The golf club head according to claim 10, wherein a maximum value of the face thickness in the toe thick-wall section and a maximum value of the face thickness in the heel thick-wall section are 0.2 mm or more greater than the face thickness at the face center.

14. The golf club head according to claim 10, wherein the up-down directional width of the striking face is measured at a position of the face center.

15. The golf club head according to claim 10, wherein the face thickness of the face central thin-wall section is less than or equal to 3.2 mm.

16. The golf club head according to claim 10, wherein the toe thick-wall section has a face-peripheral contour line, the face-peripheral contour line extending along a first circle that has its center at the face center or in a vicinity of the face center, the toe thick-wall section has a face-central contour line, the face-central contour line extending along a second circle that has its center at the face center or in the vicinity of the face center and that has a radius smaller than a radius of the first circle, the heel thick-wall section has a face-peripheral contour line, the face-peripheral contour line extending along a third circle that has its center at the face center or in the vicinity of the face center, and the heel thick-wall section has a face-central contour line, the face-central contour line extending along a fourth circle that has its center at the face center or in the vicinity of the face center and that has a radius smaller than a radius of the third circle.

17. The golf club head according to claim 10, wherein when the up-down directional length of the toe thick-wall section is denoted by W1, and a toe-heel directional length of the toe thick-wall section is denoted by W2, then W2/W1 is greater than or equal to 0.38 and less than or equal to 0.50, and when the up-down directional length of the heel thick-wall section is denoted by W3, and a toe-heel directional length of the heel thick-wall section is denoted by W4, then W4/W3 is greater than or equal to 0.40 and less than or equal to 0.54.

18. The golf club head according to claim 10, wherein the face thickness of the toe thick-wall section is greater than or equal to 2.8 mm and less than or equal to 3.8 mm, and the face thickness of the heel thick-wall section is greater than or equal to 2.8 mm and less than or equal to 3.8 mm.

19. The golf club head according to claim 10, wherein a distance between the toe thick-wall section and the heel thick-wall section in a toe-heel direction is greater than or equal to 20 mm and less than or equal to 40 mm.

* * * * *